US006326920B1

(12) United States Patent
Barnett et al.

(10) Patent No.: US 6,326,920 B1
(45) Date of Patent: Dec. 4, 2001

(54) SHEET-METAL ANTENNA

(75) Inventors: Ron Barnett, Santa Rosa, CA (US); Ilya Alexander Korisch, Somerset; Hui Wu, Union, both of NJ (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/521,727

(22) Filed: Mar. 9, 2000

(51) Int. Cl.[7] ..... H01Q 1/38

(52) U.S. Cl. ..... 343/700 MS; 343/878; 343/835

(58) Field of Search ..... 343/700 MS, 878, 343/816, 835, 810, 818, 769, 812, 815, 833, 872, 770, 771

(56) References Cited

U.S. PATENT DOCUMENTS

| | | | | |
|---|---|---|---|---|
| 3,104,362 | | 9/1963 | Matthaei | 333/73 |
| 3,754,250 | | 8/1973 | Bruner | 343/6.5 LC |
| 4,151,531 | | 4/1979 | Kaloi | 343/700 |
| 4,464,663 | * | 8/1984 | Lalezari et al. | 343/700 MS |
| 4,513,293 | | 4/1985 | Stephens | 343/840 |
| 4,736,454 | * | 4/1988 | Hirsch | 455/129 |
| 5,216,430 | * | 6/1993 | Rahm et al. | 343/700 MS |
| 5,225,799 | | 7/1993 | West et al. | 332/202 |
| 5,307,075 | * | 4/1994 | Huynh | 343/700 MS |
| 5,352,996 | | 10/1994 | Kawaguchi | 333/203 |
| 5,428,362 | | 6/1995 | Chatzipetros et al. | 343/702 |
| 5,724,717 | | 3/1998 | Gherardini et al. | 29/600 |
| 5,818,390 | * | 10/1998 | Hill | 343/700 MS |
| 5,831,578 | | 11/1998 | Lefevre | 343/700 MS |
| 5,886,669 | | 3/1999 | Kita | 343/718 |
| 5,949,383 | | 9/1999 | Hayes et al. | 343/795 |
| 5,966,102 | | 10/1999 | Runyon | 343/820 |
| 6,005,455 | | 12/1999 | Lindell et al. | 333/134 |

FOREIGN PATENT DOCUMENTS

| | | | |
|---|---|---|---|
| 19501448 | 7/1996 | (DE) | H01Q/21/30 |
| 0427479 | 5/1991 | (EP) | H01Q/21/06 |
| 0 766 333 A1 | 9/1996 | (EP) | H01P/1/202 |
| 1033779 | 9/2000 | (EP) | H01Q/1/24 |
| 04017403 | 1/1992 | (JP) | H01Q/121/24 |

* cited by examiner

*Primary Examiner*—Don Wong
*Assistant Examiner*—Chuc Tran D
(74) *Attorney, Agent, or Firm*—David Volejnicek

(57) ABSTRACT

A high-frequency, e.g., microwave, antenna (100) is stamped from a single sheet (300) of electromagnetically conductive material, e.g., a metal plate. A manufacture comprising a frame (104), a plurality of radiator antenna elements (108), a plurality of first supports (112) each connecting a radiator antenna element to the frame, a feed network (110) connected to the radiator antenna elements, and a plurality of second supports (304) connecting the radiators and the feed network to each other and to the frame, are stamped out of the single sheet. A combiner (114) may be included in the manufacture as well. The second supports provide alignment and rigidity during manufacture and assembly. Preferably, a plurality of the manufactures are stamped out side-by-side from a single roll (400) for ease of automated manufacture and assembly. The frame is either made in two pieces (200, 202) or is bent relative to the resonator antenna elements along fold lines (302), to provide an offset of the radiators from a ground plane (102). The frame is mounted on the ground plane, and the second supports are then removed. Preferably, the feed network is positioned (e.g., by being bent) to lie closer to the ground plane than the radiator antenna elements.

16 Claims, 3 Drawing Sheets

SHEET-METAL ANTENNA

TECHNICAL FIELD

This invention pertains to high-frequency, e.g., microwave, antennas.

BACKGROUND OF THE INVENTION

The recent proliferation of, and resulting stiff competition among, wireless communications products have led to price/performance demands on microwave/millimeter-wave antennas that conventional technologies find difficult to meet. This is due in large measure to high material costs and to high losses in the feed network which must be compensated for. Other problems include expensive manufacturing operations such as milling, hand-assembly, and hand-tuning, and the high numbers and required precision of metal and dielectric parts which are needed to construct these antennas.

High-volume manufacturing techniques have reduced the costs of some conventional antennas, such as the patch arrays that are used in wireless telephone systems and the off-axis parabolic dishes that are extensively used for satellite television reception. However, these techniques do nothing to improve the performance of these antennas, nor do they improve the costs of low- and medium-volume antennas. The need for low-cost high-frequency antennas has also been addressed by using "corporate feed" patch arrays printed on PC boards. Problems with this approach include large losses in the feed array, mostly due to dielectric losses in the PC board, and the high cost of the PC board itself. The losses limit the antenna's usefulness and either degrade the net performance or increase the cost of the associated transmitter and/or receiver.

SUMMARY OF THE INVENTION

This invention is directed to solving these and other problems and disadvantages of the prior art. According to the invention, an antenna is made from a single sheet of electrically conductive material, e.g., metal, such as aluminum or steel, preferably by stamping. This simple one-metal-layer antenna contains both the radiator elements and the feed (distribution) network of the antenna. These elements and network are contained within, and are attached by integral supports to, a metal frame which is also an integral element of the same layer, and form a self-supporting patch array antenna. The supporting structure also provides the necessary spacing between the radiator elements and a ground plane. The antenna can be mounted by the frame over any ground plane, e.g., an outside wall of an equipment enclosure, a single sheet of metal, or a PC board. Preferably, the antenna is stamped from the single sheet along with integral second supports that connect the radiators and feed network to each other and to the frame and provide rigidity during manufacture and assembly. The frame is preferably bent relative to the radiating elements to effect the spacing of the radiating elements from the ground plane, and the frame is mounted to the ground plane. Alternatively, that portion of the frame which lies at an angle to the plane of the radiating elements and the feed network and provides the spacing is manufactured separately, i.e., by stamping, molding, or extrusion, and is mounted to both the other portion of the frame and to the ground plane. Any second supports are then removed, e.g., cut or broken off. Preferably, the feed network is positioned closer to the ground plane than the radiating elements; this is achieved by bending the metal that forms the feed network.

Major benefits of the invention over conventional antenna designs include fewer parts, fewer process steps, easier assembly, higher performance (less loss and fewer patch elements for the same gain), higher gain for the same area and therefore smaller size, compact flat-panel form-factor, and lower cost. These and other features and advantages of the invention will become more apparent from a description of an illustrative embodiment of the invention considered together with the drawing.

DETAILED DESCRIPTION

Figure 1:
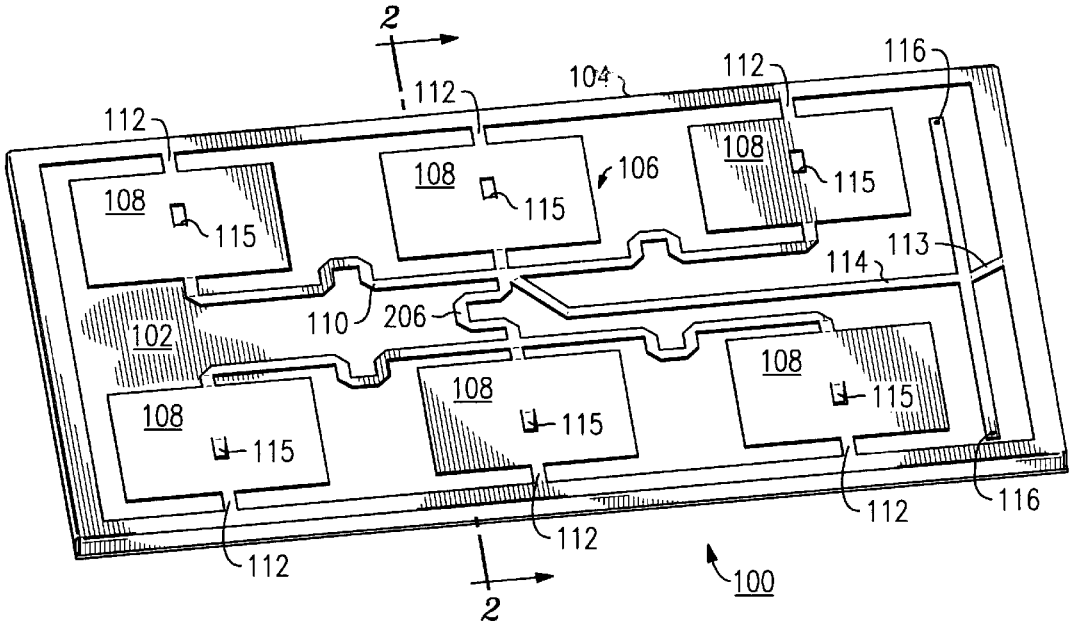
FIG. 1 is a perspective view of an antenna that includes a first illustrative embodiment of the invention.
Figure 2:
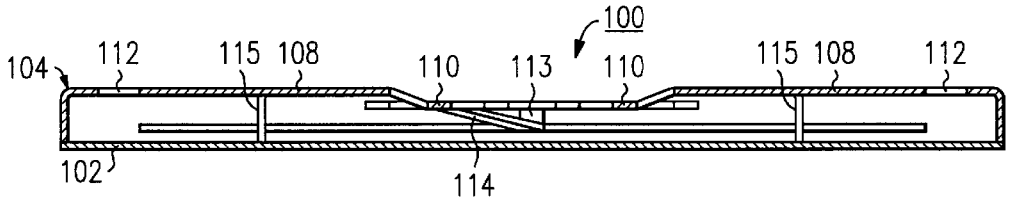
FIG. 2 is a cross-sectional view of the antenna of FIG. 1 along the line 2—2 in FIG. 1.
Figure 3:
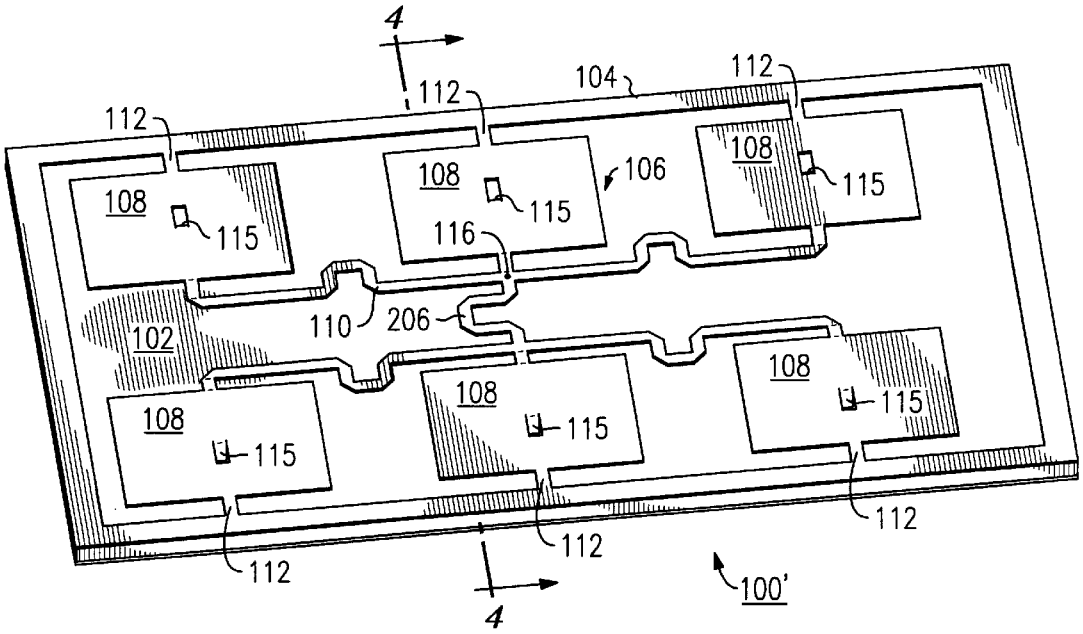
FIG. 3 is a perspective view of an antenna that includes a second illustrative embodiment of the invention.
Figure 4:
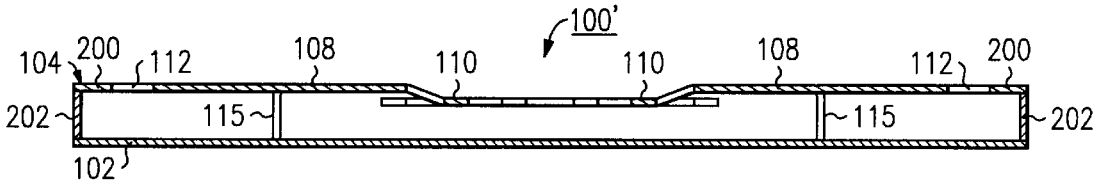
FIG. 4 is a cross-sectional view of the antenna of FIG. 3 along the line 2—2 in FIG. 3.

FIGS. 1 and 2 show a first embodiment of a high-frequency antenna 100, comprising a ground (reflector) plane 102, a frame 104, and a radiating array 106 inside frame 104. Ground plane 102 is a sheet of metal (e.g., beryllium/copper, brass, aluminum, tin-plated steel, etc., illustratively of 0.4–0.8 mm thickness) or a substrate metallized on the side that faces array 106. Frame 104 and radiating array 106 are of unitary construction, stamped, bent machined, cut, etched, or otherwise produced from a single sheet of metal, as shown in the cross-sectional view of FIG. 2. Alternatively, as shown in the cross-sectional view (FIG. 4) of a second embodiment (FIG. 3) of a high-frequency antenna 100', frame 104 may be made of two parts: one part 200 that is co-planar with radiating array 106 and another part 202 that is substantially perpendicular to part 200. Frame 104 mounts radiating array 106 over ground plane 102 and physically offsets radiating array 106 from ground plane 102. The air gap thus created acts as a dielectric layer between ground plane 102 and radiating array 106. Radiating array 106 comprises a plurality (six in this example) of radiators 108, also referred to as "patches". Each radiator 108 is connected to frame 104 by a support 112. Each radiator 108 also preferably has a standoff 115 stamped out at the radiator's null point (at its center) that extends toward ground plane 102 to maintain proper spacing of radiator 108 from ground plane 102. Radiators 108 are interconnected by a feed network 110 that connects radiating array 106 to a transmitter and/or a receiver. The transmitter and/or the receiver is normally coupled to feed network 110 at point 116', as shown in FIG. 3 for a second illustrative embodiment of the antenna. This coupling may be either conductive, e.g., via a solder joint and a coaxial connector, or capacitive. However, if antenna 100 is used for both transmission and reception, feed network 110 may form an integrated duplexer combiner in conjunction with a "T"-shaped combiner 114, shown in FIG. 1. In conventional architectures, combiner 114 forms a part of the duplexer "front end" filters. Combiner 114 is common to all radiators 108, and the transmitter and the receiver are coupled to opposite arms of the "T", at points 116. This coupling again may be either conductive or capacitive. A suitable capacitive connector is disclosed in the application of R. Barnett et al.

entitled "Resonant Capacitive Coupler," U.S. Ser. No. 09/521,724 filed on even date herewith and assigned to the same assignee. For structural stability, the center of the "T" is attached to frame 104 by a stub 113. Preferably, feed network 110 and combiner 114 lie below the plane of radiators 108, e.g., lie closer to ground plane 102. This is shown in the cross-sectional view of antenna 100 in FIG. 2. Placing feed network 110 and combiner 114 below radiators 108 in the design of antenna 100 provides more flexibility in the design of antenna 100. For example, varying the space between feed network 110 and ground plane 102 varies the impedance of feed network 110 and therefore allows the width of the conductor that forms feed network 110 to be varied.

Figure 5:
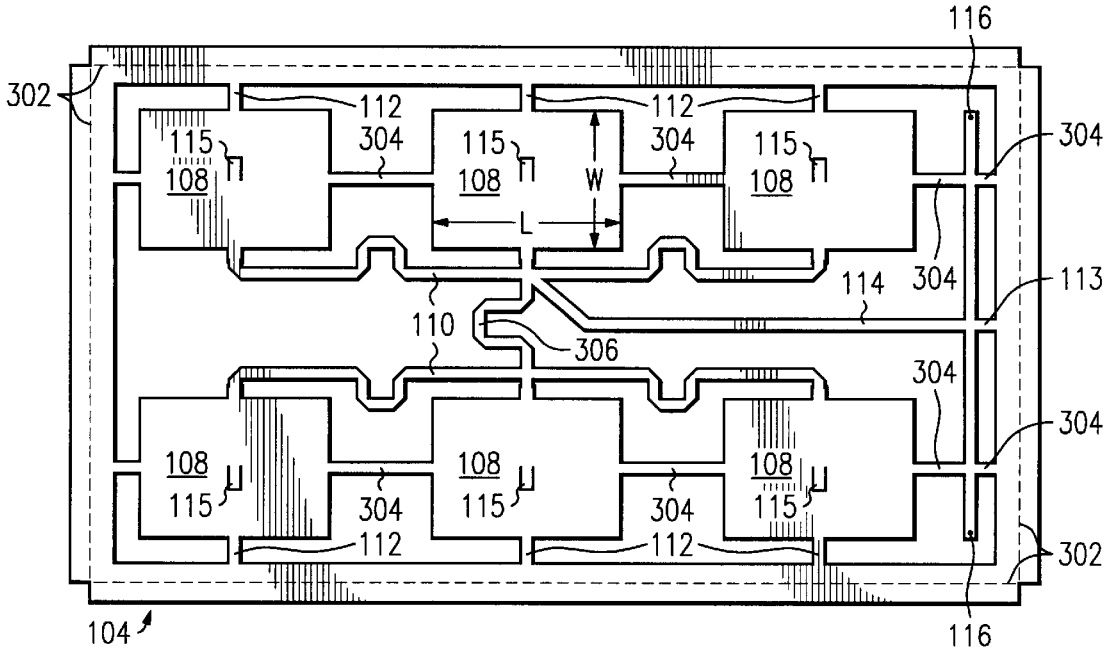
FIG. 5 is a top view of a frame-and-radiator-array unitary manufacture of the antenna of FIG. 1.
Figure 6:
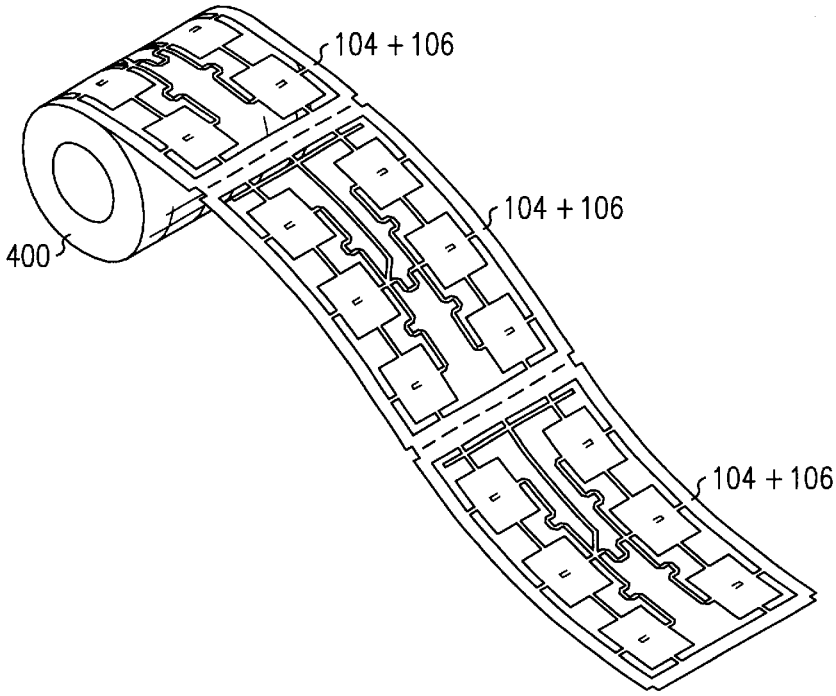
FIG. 6 is a perspective view of a roll of a plurality of the manufactures of FIG. 5.

FIG. 5 shows in greater detail the unitary construction of a manufacture that comprises both frame 104 and radiating array 106. As was mentioned previously, frame 104 and radiating array 106 are preferably stamped out of a single sheet of metal. Frame 104 is preferably stamped with fold lines 302 along which the sheet metal is then bent to form frame 104 and provide an offset of radiating array 106 from ground plane 102. If the alternative two-piece construction of frame 104 of FIG. 3 is used, then fold lines 302 are eliminated. Radiating array 106 is also preferably stamped with additional supports 304 which connect radiators 108 and combiner 114 to each other and to frame 104 to provide rigidity during manufacture and/or assembly. These supports 304 are subsequently removed, e.g., cut or broken off. The design of FIG. 5 is particularly suited for reel-to-reel, or roll, processing, where a plurality of the frame 104 and radiator array 106 manufactures are stamped into a single roll 400 of sheet metal, as shown in FIG. 6. Having a roll 400 of a plurality of these manufactures in turn assists automated assembly of antennas 100.

Feed network 110 of antenna 100 is resonant. This makes antenna 100 more tolerant of inaccuracies in line width and ground spacing, and allows for a layout that is more compact, flexible, and geared towards design for manufacturing (DFM). Adjacent rows of radiators 108 are fed at their adjacent edges 180° out of phase. This ensures wide impedance bandwidth at low ground spacing. Wide bandwidth helps to reduce mechanical tolerances and makes the design more robust.

Antenna 100 is designed to a particular gain and frequency range by varying its dimensions and the number of radiators 108. The spacing between ground plane 102 and radiating array 106 (i.e., the thickness of the dielectric) determines the bandwidth of antenna 100. The number of radiators 108 determines the gain of antenna 100. The width W (see FIG. 5) of individual radiators 108 affects their impedance and is chosen to provide desired impedance at the input point. The length L (see FIG. 5) of individual radiators 108 is close to one-half of the wavelength of the center frequency at which the antenna is to operate, and depends on the distance that separates radiators 108 from ground plane 102. The center-to-center distance between adjacent radiators 108 is about 0.7–0.8 of said wavelength. The length of segments of feed network 110 between inputs of adjacent radiators 108 is an integer multiple of (e.g., one) said wavelength. The length of segment 306 of feed network 110 between the two radiating sub-arrays is close to one-half of the wavelength. The length of stubs 112 and 113 is one-quarter of the wavelength; their width is narrow relative to their length.

Of course, various changes and modifications to the illustrative embodiments described above will be apparent to those skilled in the art. For example, while the antenna has been illustrated as a patch array antenna, other known antenna elements may be used, such as dipole and slot antenna elements. Also, two radiator arrays may be mounted on opposite sides of a single ground plane. Furthermore, the antennas may differ in the number of radiating elements and the type of feed (e.g., corporate, serial, and/or combinations thereof). Such changes and modifications can be made without departing from the spirit and the scope of the invention and without diminishing its attendant advantages. It is therefore intended that such changes and modifications be covered by the following claims except insofar as limited by the prior art.

What is claimed is:

1. An antenna comprising:

a single sheet of electrically conductive material defining at least one resonator antenna element, a frame surrounding the at least one resonator antenna element for spacing the resonator antenna element from a ground plane, at least one first support connecting each resonator antenna element to the frame, and a feed network connected to the at least one resonator antenna element for conducting electromagnetic energy to or from the resonator antenna element.

2. The antenna of claim 1 wherein:

a portion of the single sheet that defines the frame is bent relative to a portion of the single sheet that defines the at least one resonator to offset the at least one resonator from the ground plane.

3. The antenna of claim 1 wherein:

each resonator antenna element defines substantially at its center a standoff extending outwardly from the resonator antenna element for spacing the resonator antenna element from the ground plane.

4. The antenna of claim 1 further comprising:

the ground plane, mounted to the frame.

5. The antenna of claim 4 wherein:

the feed network is positioned closer to the ground plane than the at least one resonator antenna element.

6. The antenna of claim 1 wherein:

the feed network forms an integrated duplexer combiner.

7. The antenna of claim 1 wherein:

the at least one resonator antenna element is a patch array of a plurality of the resonator antenna elements.

8. The antenna of claim 7 wherein:

the plurality of resonator antenna elements are connected in phase with each other to the feed network.

9. The antenna of claim 7 wherein:

the patch array comprises a pair of patch sub-arrays each comprising at least one resonator antenna element and the sub-arrays are connected substantially 180° out of phase with each other to the feed network.

10. The antenna of claim 9 wherein:

each sub-array comprises a plurality of resonator antenna elements that are connected in phase with each other to the feed network.

11. A method of making the antenna of claim 1 comprising:

stamping the resonant antenna element, the frame, the first support, and the feed network from the single sheet.

12. The method of claim 11 further comprising:

bending the frame relative to the resonant antenna element to effect the spacing of the resonator antenna elements.

13. The method of claim 11 further comprising:

stamping a standoff substantially from a center of each resonant antenna element; and bending the standoff outwardly from each antenna element;

the standoffs being for spacing the resonator antenna elements from the ground plane.

14. The method of claim 11 further comprising:

additionally stamping at least one second support connecting at least one resonator antenna element or the feed network to another resonator antenna element or the frame;

mounting the frame on the ground plane; and removing the at least one second support.

15. The method of claim 14 further comprising:

prior to the mounting, bending the frame relative to the resonant antenna element to effect the spacing of the resonator antenna elements.

16. An antenna made by the method of claim 11 or 12 or 13 or 14 or 15.

* * * * *